United States Patent [19]
Sinkkonen
[11] 4,281,945
[45] Aug. 4, 1981

[54] ROLLER ASSEMBLY FOR REFUSE CRUSHERS

[76] Inventor: Matti S. Sinkkonen, 40950 Muurame Kp 1, Finland

[21] Appl. No.: 69,165

[22] Filed: Aug. 23, 1979

[30] Foreign Application Priority Data

Aug. 25, 1978 [FI] Finland ..... 782616

[51] Int. Cl.[3] ..... E01C 19/26

[52] U.S. Cl. ..... 404/121; 172/540; 301/43

[58] Field of Search ..... 404/121, 122, 117, 124; 301/43, 44, 52; 172/518, 537, 540, 554; 29/121.1

[56] References Cited

U.S. PATENT DOCUMENTS

| | | | |
|---|---|---|---|
| 3,067,658 | 12/1962 | Palmiter | 404/121 |
| 3,085,484 | 4/1963 | McAdams | 404/121 |
| 3,259,036 | 7/1966 | Peterson | 404/121 |
| 3,277,802 | 10/1966 | Petersen | 404/121 |
| 3,566,761 | 3/1971 | Domenighetti | 404/122 |
| 3,633,471 | 1/1972 | Randour | 404/121 |
| 3,859,910 | 1/1975 | Swanson | 404/121 X |
| 3,922,106 | 11/1975 | Caron | 404/121 |

*Primary Examiner*—Nile C. Byers, Jr.
*Attorney, Agent, or Firm*—Steinberg & Raskin

[57] ABSTRACT

Roller assemblies for refuse crushers or the like are provided wherein a roller element having axial end faces and a cylindrical surface carrying refuse crushing means is provided. Structure for supporting the roller element includes a pair of end faces, each of which is situated in opposed, spaced relation to a corresponding one of the axial end faces of the roller element. Crushing apparatus is provided on the opposed end faces of the roller element and support structure which crush refuse which might enter the space between the roller element and the support end faces.

9 Claims, 5 Drawing Figures

ROLLER ASSEMBLY FOR REFUSE CRUSHERS

BACKGROUND OF THE INVENTION

The refuse crushers which are used for the crushing of refuse for dumps are generally ordinary tracked bulldozers or are converters which are converted from conventional wheel loaders. These devices, however, do not permit the moving of an adequate amount of refuse into the dump area because the refuse cannot, with these devices, be sufficiently compacted.

Still further, the equipment generally used as crushers of refuse for dumps and the like are generally such that the surface of the dump cannot be made sufficiently passable for driving through with refuse transportation trucks.

The most highly developed refuse crushers which are used include rollers which are provided with fashioned teeth on their circumferential surfaces. Such rollers are arranged on both the front axle and the rear axle of the crusher. These fashioned teeth on the rollers provide the advantage of compacting the refuse which is carried to the dump. At the same time, the surface of the dump becomes passable, even for large refuse bearing trucks, when equipment with these rollers is used in the dump.

However, the toothed roller structure of these crushers are highly susceptiple to damage of the axle portion thereof. Thus, during crushing of wires, ropes, and the like, the materials easily become caught in the cavities between the teeth and soon get wound around the crushing rollers. More importantly, these materials often get wound onto the driving axle of the roller thus damaging the bearings. Even when the material is caught before it has an opportunity to damage the bearings, the detaching of the tightly wound wire, rope or the like from the axle is extremely difficult.

SUMMARY OF THE INVENTION

Generally speaking, in accordance with the invention a roller assembly for use in refuse crushers or the like is provided which comprises a roller element having an axis of rotation and axial end faces, the roller element having a substantially cylindrical surface extending between the end faces and being provided with refuse crushing means, such as a toothed structure or the like. Means for supporting the roller element for rotation about the axis is provided, the supporting means including a surface adjacent to and spaced from a corresponding end face of one of the roller elements. The surface of the end face of the roller and a surface of the support means adjacent thereto is provided with cooperating means for crushing any refuse which enters into the space between the roller and the support.

It is thus a primary object of the present invention to provide a roller assembly for refuse crushers or the like which avoids the above mentioned disadvantages of the known roller crushers.

It is another object of the present invention to provide roller assemblies for refuse crushers which prevent wire, rope and other objects from winding around and possibly damaging the bearings or driving axle of the roller.

It is yet another object of the present invention to provide a simple construction which permits dense compacting of refuse for dumps and the like while avoiding damage to the roller assembly.

Other objects and advantages of the present invention will be apparent from a further reading of the specification and of the appended claims.

The present invention accomplishes improvements in crushers provided with rollers carrying teeth or the like for the crushing of refuse by equipping the ends of the roller and/or the support for the roller with refuse crushing means such as grinding regions for the crushing of any refuse which enters the space between the roller and the support.

The roller structure of the present invention make it possible to eliminate the disadvantages of the previously known roller structures because wires, ropes and the like are crushed and break in the area between the end of the roller and the support surface of the bearing, which area is formed according to the invention with crushing surfaces which face or oppose each other. This prevents the wire and rope from winding around the axle and damaging the axle and/or bearings.

The invention accordingly comprises the features of construction, combinations of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF PREFERRED EMBODIMENTS

Figure 1:
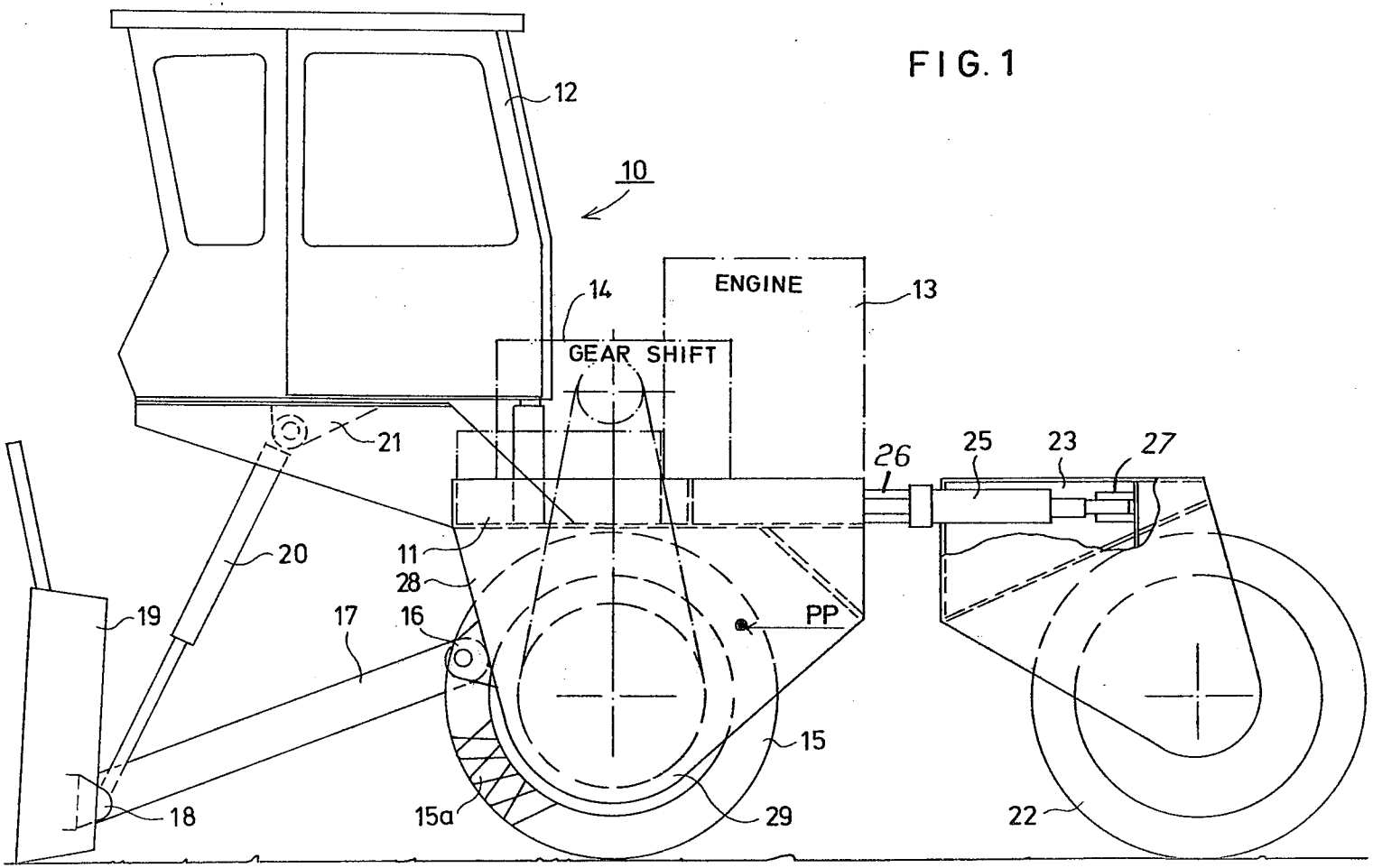
FIG. 1 is a side view showing a refuse crusher provided with a roller unit in accordance with the present invention.
Figure 2:
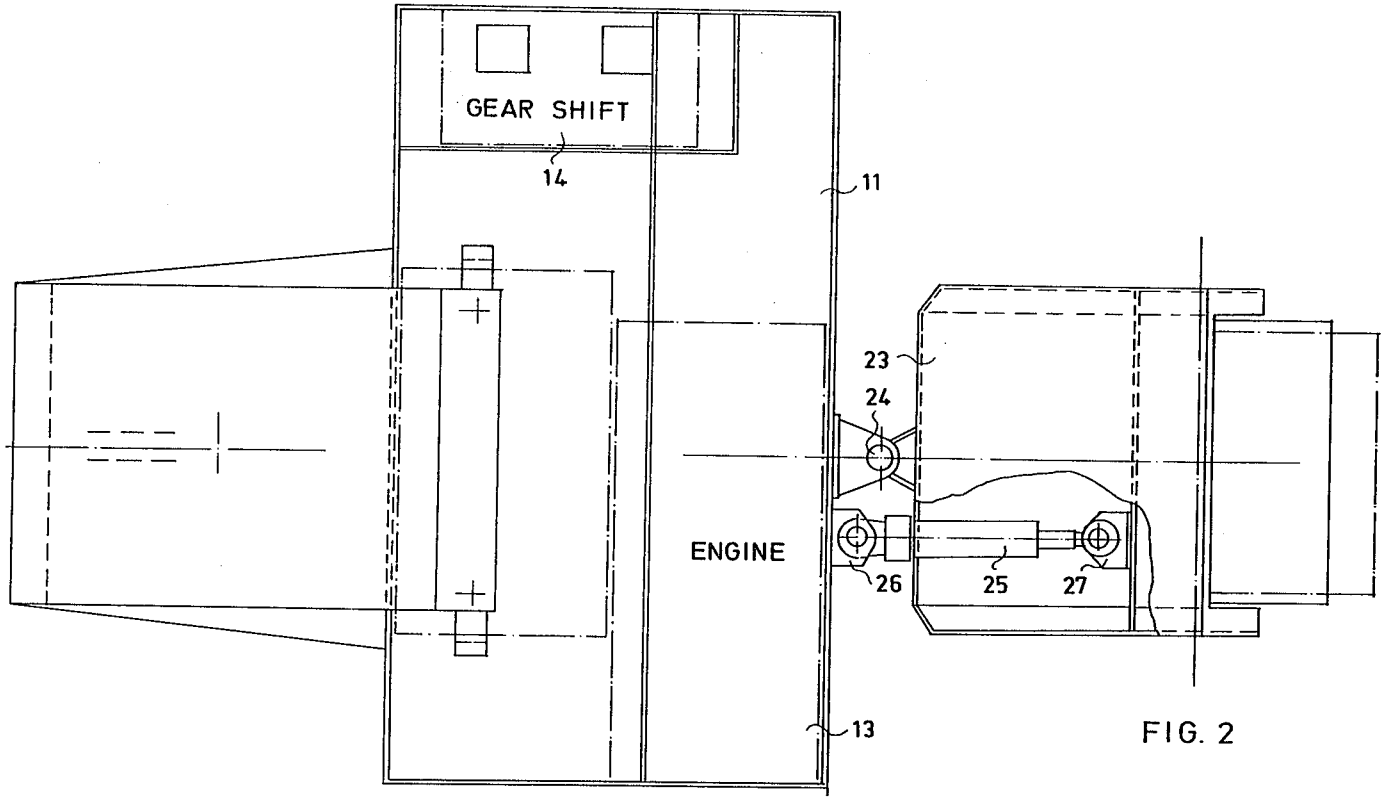
FIG. 2 is a plan view of the refuse crusher of FIG. 1.

A refuse crusher for use, for example at dumps, is shown in FIGS. 1 and 2 and in general identified by reference numeral 10. The refuse crusher 10 is provided with a chassis 11, a cab 12, an engine 13 and a gear shift 14. The refuse crusher 10 further is provided with roller assembly including a roller 15 provided with teeth such as fashioned teeth 15*a* on its circumferential surface.

Mounting brackets 16 are fixed to the chassis 11 and arms 17 are attached to the brackets 16 so that the arms are in swinging engagement. The other ends of the arms 17 are attached to a bulldozer type blade 19 which is provided with mounting brackets 18. Raising cylinders 20 are attached to the brackets 18 so that the cylinders can swing. The other ends of the raising cylinders 20 are swingably attached to mounting brackets 21 on the chassis 11.

In order to prevent backward toppling, a device is provided which includes a stearable rear wheel 22 located behind the refuse crusher 10. The rear chassis is identified by reference numeral 23 and is attached to the chassis 11 by means of an articulation 24 (shown in FIG. 2). For steering purposes the rear wheel 22 is attached by means of a steering cylinder 25 at one end to the rear chassis 23 by means of a mounting bracket 27 and at its other end to the chassis 11 by means of mounting bracket 26.

Almost the entire weight of the waste or refuse crusher 10 of FIGS. 1 and 2 is centered on the roller 15. The full weight of the chassis 11, the cab 12 and the transmission 13 and 14 of the crusher 10 is thus concentrated on the roller 15. In order to prevent forward toppling, the bulldozer blade 19 is spaced from the crusher 10 forwardly at a distance sufficient to prevent such forward toppling. On the other hand, the steering wheel 22 prevents backward toppling of the crusher and receives the moment from the forward-driving and butting of the refuse crusher. The refuse crusher 10 thus rocks between the bulldozer blade 19 and the rear wheel 22.

The structure of the refuse crusher 10 is made in such a manner as to try to bring the point of gravity PP (FIG. 1) as close as possible to the front axle. However, in accordance with operating features of the refuse crusher 10 it is advantageous that the point of gravity be slightly behind the front axle of the crusher.

The roller assembly 15 of the refuse crusher may be made so as to consist of two halves in which case the crusher 10 can be adequately steered merely by means of the roller assembly, with each half of the roller pulling independently of the other half. In such case, the rear wheel 22 is no longer indispensable and can be replaced, for example, by a runner assembly, since adequate steering of the refuse crusher can be accomplished by the steering of the roller assembly.

Figure 3:
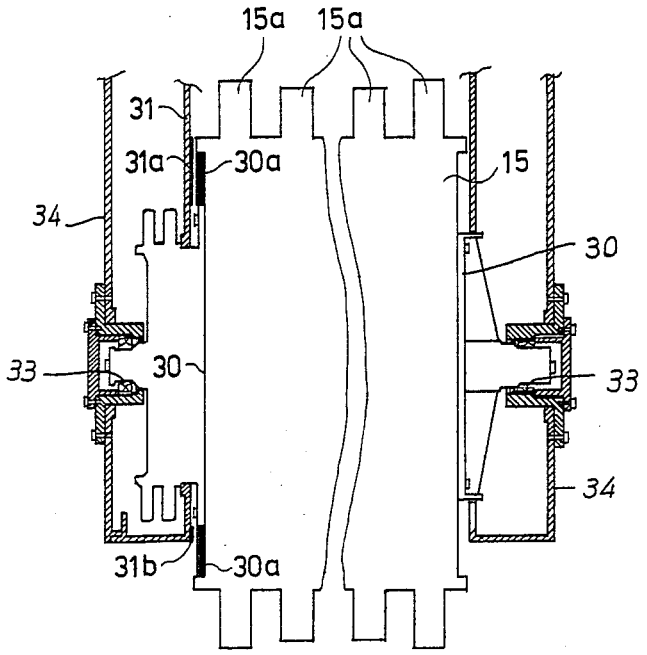
FIG. 3 is a schematic view of the roller assembly of the present invention.

FIG. 3 shows the roller assembly of the present invention in greater particularity. The roller structure of the roller assembly 15 is provided with axial end faces 30 which are provided with durable lateral refuse crushing elements or bodies 30*a*. Bearing 33 is carried by a support element 34 and is arranged to carry the roller 15. The support element is provided with axial end faces or surfaces 31 which, as seen in FIG. 3, are in opposed relationship to and spaced outwardly from corresponding respective end faces 30 of the roller 15. The surfaces 31 carry durable lateral refuse crushing elements or bodies 31*a*, 31*b*. These lateral refuse crushing elements are shown in FIG. 3 only at one set of opposed axial end faces of the roller 15 and the bearing and support assembly 33, 34. However, the same refuse crushing means are provided at the other set of opposed axial end faces.

In accordance with a preferred embodiment of the present invention advantages are achieved by providing that the refuse crushing elements 30*a* on each of the axial end faces 30 of the roller 15 are substantially thicker than the cooperating refuse crushing elements 31*a*, 31*b* on the respective axial end face 31 of the bearing and support assembly 33, 34.

Also, as can be seen from FIG. 1, a housing 28 is provided which laterally protects the roller 15 and is shaped as an arch at its lower edge 29 so that the inner surface of the housing in the region of its lower edge 29, in terms of its width in the direction of the radius, is much smaller than the inner surface of the housing in the region of its upper edge. Still further, it is advantageous in accordance with the present invention to provide the refuse crushing elements 31*a*, 31*b* in such manner that the same have a radial width which is smaller in the region of the lower edge of the axial end face 31 of the bearing and support 33, 34, than in the region of the upper edge thereof. In contrast thereto, the refuse crushing elements 30*a* on the axial end faces of the roller 15 are provided to have a uniform radial width.

Figure 4:
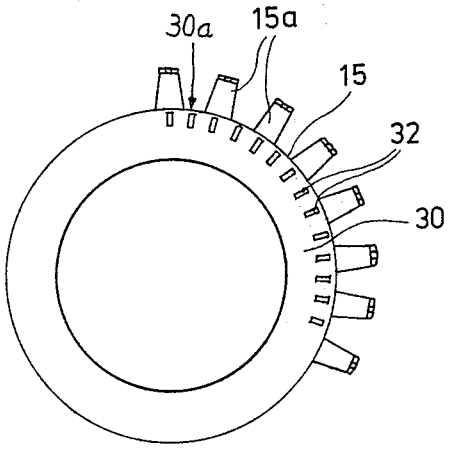
FIG. 4 is a view showing one axial end face of the roller unit and showing one embodiment of the invention.

FIG. 4 shows one axial end face 30 of the roller 15 in accordance with one embodiment of the invention. The refuse crushing elements 30*a* consist of a plurality of wear resistant crushing teeth 32. Similarly, the refuse crushing elements 31*a*, 31*b* of the axial end faces 31 of the bearing and support assembly 33, 34 consist of teeth (not shown) which match with the teeth 32. Thus, the axial end faces 30 and 31 are toothed, it being understood that the teeth of the refuse crushing elements 30*a* and 31*a*, 31*b* are constructed and arranged in such a manner as to cooperate with each other so as to crush wire, ropes and other objects which might penetrate between the axial end faces 30 and 31 of the roller 15 and the bearing and support assembly 33, 34.

Figure 5:
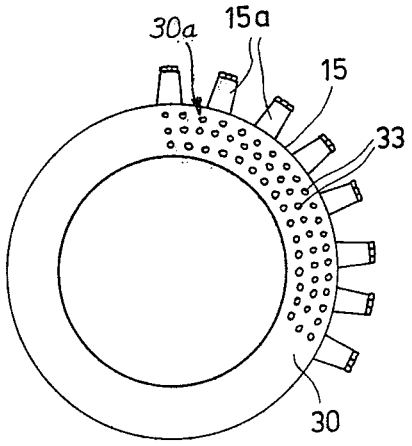
FIG. 5 is a view showing one axial end face of the roller unit constructed in accordance with another embodiment of the invention.

FIG. 5 shows an axial end face 30 of the roller 15 in accordance with another embodiment of the invention. The refuse crushing elements 30*a* of the axial end face 30 of the roller 15 are formed by welding hard metal bits 33 onto the surface. Thus, the refuse crushing elements 30*a* form a surface such as that of millstone. Similarly, the refuse crushing elements 31*a*, 31*b* are made of hard metal bits (not shown) which are similar to the hard metal bits 33.

By providing a refuse crusher 10 or any similar crushing machine with a roller assembly designed in accordance with the present invention, wires, ropes and the like can not wind around the axle of the roller 15 because the same are crushed before they can wind around the axle. These pieces of refuse are crushed and break in the regions between the axial end faces 30 of the roller and the axial end faces 31 of the bearing and support assembly 33, 34 by reason of the lateral refuse crushing elements 30*a* and 31*a*, 31*b*, respectively which face each other.

It will thus be seen that the objects set forth above, among those made apparent from the preceeding description, are efficiently attained and, since certain changes may be made in the above constructions without departing from the spirit and scope of the invention, it is intended that all matter contained in the above description are shown in the accompanying drawings shall be interpreted as illustrative and not in a limiting sense.

What is claimed is:

1. A roller assembly, particularly for use in a refuse crusher or the like, comprising:

a roller element having an axis of rotation and two axial end faces, and a substantially cylindrical surface extending between said end faces having refuse crushing means provided thereon;

means for supporting said roller element for rotation about said axis, said supporting means including at least one surface in opposing relationship to and spaced outwardly from a corresponding one of said roller element end faces to define a space therebetween contiguous with said corresponding one of said roller element end faces; and cooperating means provided on said at least one surface and said corresponding roller end face for crushing refuse which enters into said space therebetween.

2. Roller assembly according to claim 1, wherein cooperating means are provided on both said one surface and said corresponding roller end face.

3. Roller assembly according to claim 2, and wherein said cooperating means are provided on both axial end faces and on the corresponding surfaces of said supporting means.

4. Roller assembly according to claim 3, and wherein said refuse crushing means provided on said substantially cylindrical surface of said roller element are in the form of a toothed structure.

5. Roller assembly according to claim 1, wherein said cooperating means is formed as a toothed structure.

6. Roller assembly according to claim 1, and wherein said cooperating means are formed of bits of hard metal secured to said surface and corresponding roller end face.

7. Roller assembly according to claim 2, wherein said cooperating means on the surface of said roller end face is thicker than the cooperating means on said at least one surface.

8. Roller assembly according to claim 2, and wherein the surface of said supporting means has a lower edge region and an upper edge region and wherein the thickness of said cooperating means provided on the surface of said supporting means at the lower edge region is smaller than the thickness thereof at its upper edge region.

9. Roller assembly according to claim 1 wherein said spporting means include a pair of surfaces, each of which is in opposed relationship to and spaced outwardly from a corresponding respective one of said two roller element end faces.

* * * * *